US005287976A

United States Patent [19]

Mayer et al.

[11] Patent Number: 5,287,976

[45] Date of Patent: Feb. 22, 1994

[54] SYSTEM AND METHOD FOR CO-MAILING A PLURALITY OF DIVERSE PUBLICATIONS

[75] Inventors: Theodore W. Mayer, Chicago; Nicholas A. Martellotto, Wheaton; Glenn R. Scott, Glen Ellyn, all of Ill.

[73] Assignee: R. R. Donnelley & Sons Company, Lisle, Ill.

[21] Appl. No.: 607,245

[22] Filed: Oct. 31, 1990

[51] Int. Cl.[5] ..... B07C 5/00

[52] U.S. Cl. ..... 209/547; 209/584; 209/900; 364/405

[58] Field of Search ..... 209/547, 569, 583, 584, 209/900; 364/405

[56] References Cited

U.S. PATENT DOCUMENTS

| | | | |
|---|---|---|---|
| 3,774,758 | 11/1973 | Sternberg | 209/569 X |
| 3,891,492 | 6/1975 | Watson . | |
| 3,953,017 | 4/1976 | Wise . | |
| 4,117,975 | 10/1978 | Gunn | 209/584 X |
| 4,168,776 | 9/1979 | Hoeboer . | |
| 4,247,008 | 1/1981 | Dobbs | 209/569 |
| 4,413,724 | 11/1983 | Fellner . | |
| 4,483,526 | 11/1984 | Bulka et al. . | |
| 4,484,733 | 11/1984 | Loos et al. . | |
| 4,519,598 | 5/1985 | McCain et al. . | |
| 4,537,342 | 8/1985 | McCain et al. . | |
| 4,552,349 | 11/1985 | Loos et al. . | |
| 4,556,595 | 1/1986 | Fustier | 209/569 X |
| 4,567,988 | 2/1986 | Weibel | 209/569 X |
| 4,601,394 | 7/1986 | Hutner | 209/584 X |
| 4,789,147 | 12/1988 | Berger et al. . | |
| 4,800,505 | 1/1989 | Axelrod et al. | 209/584 X |
| 4,800,506 | 1/1989 | Axelrod et al. . | |
| 5,009,321 | 4/1991 | Keough | 209/584 X |
| 5,042,667 | 8/1991 | Keough | 209/584 X |
| 5,104,681 | 4/1992 | Sansone | 209/584 X |
| 5,119,954 | 6/1992 | Svyatsky et al. | 209/584 |

FOREIGN PATENT DOCUMENTS 2577151 8/1986 France ..... 209/547

OTHER PUBLICATIONS

Sitma Brochure—Automatic Poly-Wrap & Polymatic Systems-(no date).
Harris Brochure—Counter/Stackers-(no date).
Muller Martini AVS Brochure-(no date).
Muller Martini PrintRoll-P Brochure-(no date).
Rolco Brochure-(no date).

*Primary Examiner*—D. Glenn Dayoan
*Attorney, Agent, or Firm*—Wood, Phillips, VanSanten, Hoffman & Ertel

[57] ABSTRACT

In order to maximize postal discounts in connection with binding line operations, a system and method for co-mailing a plurality of diverse publications to their intended recipients is disclosed. The system and method contemplate preparing and addressing copies of each of the diverse publications on at least one binding line. Mailing information is then recorded for each of the diverse publications exiting from the binding line. The diverse publications are then each assembled in a predetermined order as the copies exit from the binding line following which each of the diverse publications is placed in position for feeding each of the copies to a co-mailing line in a predetermined order relative to the order of exit from the binding line. Mailing information is then assembled for all of the diverse publications to control or otherwise facilitate the operation of the co-mailing line by permitting the diverse publications to be accumulated for co-mailing purposes. Next, the assembled mailing information is utilized for feeding copies of the diverse publications to the co-mailing line. With this operation, the copies fed to the co-mailing line are accumulated into co-mailing stacks formed by copies having a common indicia of assembled mailing information after which the co-mailing stacks are prepared for mailing.

137 Claims, 4 Drawing Sheets

SYSTEM AND METHOD FOR CO-MAILING A PLURALITY OF DIVERSE PUBLICATIONS

FIELD OF THE INVENTION

The present invention is generally directed to a procedure for mailing a variety of publications and, more particularly, to a system and method for co-mailing a plurality of diverse publications.

BACKGROUND OF THE INVENTION

As will be appreciated, there have been a wide variety of systems for collating and binding signatures in a binding line operation. One prior type of collating and binding system is disclosed in commonly owned U.S. Pat. No. 4,121,818 of Riley et al. which discloses a plurality of signature feeders disposed adjacent a conveyor wherein the signature feeders are individually operated by a programmable controller so that customized books are built in accordance with information contained on a magnetic tape. In addition, means are provided along the conveyor to detect defective books which are removed by a diverter operated by the programmable controller.

As disclosed in Riley et al., the system is particularly useful to permit customized information and/or signatures to be placed in books produced during a single production run. In other words, each book can be customized for the person to whom it is to be sent. Then, these books are collated and bound in a predetermined sequence for bundling for the purpose of taking advantage of postal discounts or to otherwise meet postal regulations.

The assembling of customized books in a particular sequence to permit bundling according to postal regulations was difficult to achieve in an optimal fashion in the event a defective book was detected, rejected and reordered. In such a case, the Riley et al. system compared the mailing information of the defective book with the mailing information of the book adjacent the first signature feeder (or the "most recent book") to determine the optimal time to reorder the book. For example, if the defective book and the most recent book had the same zip code, the defective book could be immediately reordered and grouped with other books having the same zip code to obtain postal discounts.

On the other hand, if the zip code of the most recent book was different than that of the defective book, then the defective book was reordered following the last book within the same sectional center facility destination. Thus, the time for reordering was determined in accordance with a comparison of the mailing information of the defective book with the mailing information of the most recent book on the conveyor. However, in some cases, the book might no longer be able to qualify for a certain postal discount because of the zip code sequence and might instead be subject to a higher postal rate than other books that did so qualify.

By way of example, a book might originally be classified in a discount classification along with other books that are to be delivered to the same five digit zip code area. If this book was found to be defective for some reason and was reordered at a time such that it no longer was grouped with other books of the same zip code, then this book could not qualify for the discount postage rate previously applicable. As for the Riley et al. system, it was not capable of generating an indication of the change in postage, if any, caused by the reordering by the defective book.

Also, it could sometimes happen that the reordering of a defective book might cause not only the reordered book to be subject to a higher postage rate but also cause the other books with which the reordered book was originally grouped to be subject to a higher rate since the remaining books might not meet the minimum requirements either in terms of number or weight for the postal discount.

In order to address these problems, commonly owned U.S. Pat. No. 4,674,052 of Wong et al. and U.S. Pat. No. Re. 32,690 of Wong proposed various solutions. These patents generally address the problem of generating an indication of the incremental increase in postage for a grouping of books which originally qualified for a postal discount but which no longer qualify due to the reordering of one or more books in the group as well as the problem of reordering a defective book which originally qualified for a postal discount at a point in the sequence wherein the book qualifies for another postal discount or, if unavailable, at a point in the sequence which causes the book to be classified in the highest postal rate category. While these represent significant advancements in the art, still another possible means for qualifying books for postal discounts has been substantially unavailable.

Specifically, there has been no entirely satisfactory system for merging different book titles for postal discount purposes. Thus, while there have been certain existing co-mailing devices such as those known as demo-mailers, merge mailers and co-minglers, they have not been suitable for accomplishing the objective of co-mailing, i.e., merging various magazine titles such as Time, Sports Illustrated, Newsweek, etc. (hereinafter referred to as "diverse publications") where such titles or publications have been bound and addressed on one or more binding lines at the same or different locations, in order to present direct packages to the U.S. Postal Service presorted by zip code and carrier route, to take full advantage of postal discounts. At present, an analysis shows that co-mailing in such manner can serve to reduce postage to a commercially significant degree.

Moreover, it is essential for any such co-mailing to be able to handle selectively gathered or personalized books and in a manner unlike the existing co-mailing devices mentioned hereinabove. These have been both undesirably slow and labor intensive and, as such, they cannot be economically or successfully utilized on a commercial basis for such purposes. As a result, it has remained to provide a co-mailing system and method for merging various magazine titles into a single mail stream to achieve the highest level of mail sortation for receiving maximum postage discounts.

The present invention is directed to overcoming one or more of the foregoing problems and achieving one or more of the resulting objects.

SUMMARY OF THE INVENTION

It is a principal object of the present invention to provide a system and method for co-mailing a plurality of diverse publications. It is a further object of the present invention to provide such a co-mailing system and method wherein such diverse publications may include selectively gathered or personalized books that can be merged into a single mail stream. It is yet another object of the present invention to provide a co-mailing system and method which successfully maximizes postal discounts.

Accordingly, the present invention is directed to a system and method for co-mailing a plurality of diverse publications in a practical manner. It does this in such a way as to eliminate the possibility of a subscriber's name being applied to the wrong magazine which is known to be a critical requirement for achieving commercially acceptable merging of various magazine titles from different publishers. In addition, the co-mailing can merge selectively gathered or personalized books and the operating cost is reduced because of the higher speed and automation involved.

As for the method, it includes the step of preparing and addressing copies of each of the diverse publications on the same or different binding lines. Then, mailing information is recorded for each of the diverse publications so prepared and addressed on the binding line(s). Next, each of the diverse publications is assembled in a predetermined order as the copies exit from the binding line(s) following which each of the diverse publications is placed in position for feeding each of the copies to a co-mailing line. In particular, the diverse publications are each placed for feeding each of the copies in a predetermined order relative to the order of exit from the binding line(s). Then, mailing information is assembled for all of the diverse publications to control or otherwise facilitate operation of the co-mailing line by permitting the diverse publications to be accumulated for co-mailing purposes following which the assembled mailing information is utilized to feed copies of the diverse publications to the co-mailing line. Next, copies of the diverse publications fed to the co-mailing line are accumulated into co-mailing stacks formed by copies of the diverse publications having a common indicia of the assembled mailing information. Finally, the co-mailing stacks of accumulated copies of diverse publications are prepared for mailing.

With this understanding of the inventive method, the preparing and addressing step will advantageously include preparing at least one of the diverse publications with personalized copies for certain applications. Also, the mailing information recording step will advantageously include sequentially recording an exact count by zip code. Further, the mailing information assembling step will advantageously include determining the number of copies for each zip code for the diverse publications. Still further, the utilizing step will advantageously include the feeding of copies of the diverse publications to the co-mailing line substantially in zip code order. Additionally, the accumulating step will advantageously include sequentially accumulating copies of the diverse publications into co-mailing stacks in zip code order.

In another respect, the assembling step will advantageously include sequentially assembling every copy of each of the diverse publications on a separate spirally wound bundle or reel. The method will also advantageously include providing a common co-mailing line for all of the diverse publications wherein the co-mailing line includes a separate publication feeder for each of the diverse publications and an accumulating conveyor adapted to receive publications from the publication feeders by passing an exit point of each of the publication feeders for each of the publications. With this arrangement, the separate spirally wound bundles or reels will each advantageously be placed in a preselected location relative to one of the publication feeders.

In addition, the method will advantageously include preparing and addressing multiple copies of each of the diverse publications on one or more binding lines at the same or remote binding plants or facilities. It is also contemplated that the mailing information assembling step will advantageously include determining the exact number of copies not only for each zip code but also each carrier route. Still further, the assembled mailing information will advantageously be utilized to control or otherwise facilitate operation of the co-mailing line for feeding the diverse publications in a predetermined sequence to the accumulating conveyor.

In yet another form of the invention, the assembling step includes sequentially assembling every copy of each of the diverse publications onto separate pallets. The method then contemplates the placing step including separately placing each of the pallets in a preselected location relative to one of the publication feeders. Preferably, the publication feeders each include a pallet load inverter together with a copy inverting gripper.

As for the system, it includes means for preparing and addressing copies of each of the diverse publications on the same or different binding lines. Also, means are provided for recording mailing information for each of the diverse publications so prepared and addressed by the preparing and addressing means on the binding line(s). The system further includes means for assembling each of the diverse publications in a predetermined order as the copies exit from the binding line(s). A co-mailing line is provided for preparing a plurality of diverse publications for co-mailing therefrom. The system still further includes means for placing each of the diverse publications in position for feeding each of the copies to the co-mailing line in a predetermined order relative to the order of exit from the binding line(s). Additionally, means are provided for assembling the mailing information for all of the diverse publications to control or otherwise facilitate operation of the co-mailing line by permitting the diverse publications to be accumulated for co-mailing purposes. With this arrangement, the system includes means for utilizing the assembled mailing information to feed copies of the diverse publications to the co-mailing line.

Still further, the system includes means for accumulating the copies of the diverse publications fed to the co-mailing line into co-mailing stacks. These co-mailing stacks are formed by copies of the diverse publications having a common indicia of the assembled mailing information. Finally, the system includes means for preparing the co-mailing stacks of accumulated copies of diverse publications for mailing to the intended recipients thereof.

In an exemplary embodiment, the preparing and addressing means will advantageously include a plurality of signature feeders and a gathering chain for receiving signatures from the feeders. It also will advantageously include a binding machine for binding the signatures into the publications along with an ink jet printer for addressing each of the diverse publications at a point before the copies exit from the binding line. Still further, the preparing and addressing means will advantageously be adapted to prepare at least one of the diverse publications with selectively bound and/or internally customized copies.

Preferably, the system includes means for sequentially recording mailing information for each of the diverse publications in a predetermined order as the copies exit from the binding line(s) to provide an exact count by zip code. Also, the system will advantageously include means for assembling the mailing information for all of the diverse publications while determining the number of copies for each zip code for the diverse publications and means for utilizing the assembled mailing information to feed copies of the diverse publications to the co-mailing line substantially in zip code order. Still additionally, the system will advantageously include means for sequentially accumulating the copies of the diverse publications fed to the co-mailing line into co-mailing stacks in zip code order for the purpose of maximizing postal discounts.

As with the method, the system also preferably contemplates providing an exact count by zip code and carrier route. In one embodiment, the assembling means advantageously includes a separate spirally wound bundle or reel for sequentially assembling every copy of each of the diverse publications thereon and the placing means includes means for separately moving each of the separate spirally wound bundles or reels to a preselected location relative to one of the publication feeders. In another embodiment, the assembling means includes a separate pallet for sequentially assembling every copy of each of the diverse publications thereon and the placing means includes means for separately moving each of the separate pallets to a preselected location relative to one of the publication feeders. In either case, a common co-mailing line is provided for all of the diverse publications.

More specifically, the co-mailing line preferably includes a separate publication feeder for each of the diverse publications. It also advantageously includes an accumulating conveyor adapted to receive publications from the publication feeders. With this arrangement, the accumulating conveyor preferably passes an exit point of each of the publication feeders.

Still additional details of the system include means for assembling the mailing information for all of the diverse publications while determining the exact number of copies of diverse publications for each zip code and carrier route. The assembled mailing information utilizing means is then advantageously adapted to control or otherwise facilitate operation of the co-mailing line whereby the diverse publications are fed in a predetermined sequence by the publication feeders to the accumulating conveyor substantially in zip code and carrier route order. In this manner, the copy accumulating means is adapted to accumulate copies of the diverse publications into co-mailing stacks in zip code and carrier route order for mailing purposes.

Other objects, advantages and features of the present invention will be apparent from a consideration of the following specification taken in conjunction with the accompanying drawings.

DETAILED DESCRIPTION OF THE PREFERRED EMBODIMENTS

Referring to FIGS. 1 through 6, various aspects of the present invention are fully disclosed for illustration purposes only. It will be understood, however, that while these aspects of the invention represent the best mode presently known, they do not fully encompass the invention and its wide range of possibilities. On the contrary, the invention can be utilized for many other applications and combinations that are comprehended as covered herein.

Figure 1:
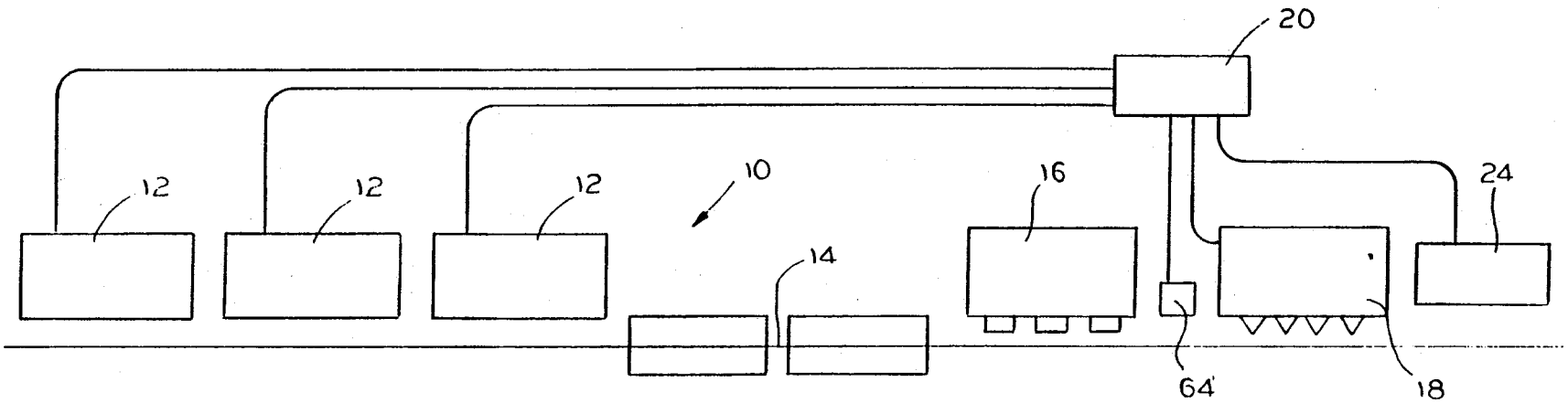
FIG. 1 is a schematic view of a binding line for the method and system for co-mailing a plurality of diverse publications in accordance with the present invention.
Figure 3:
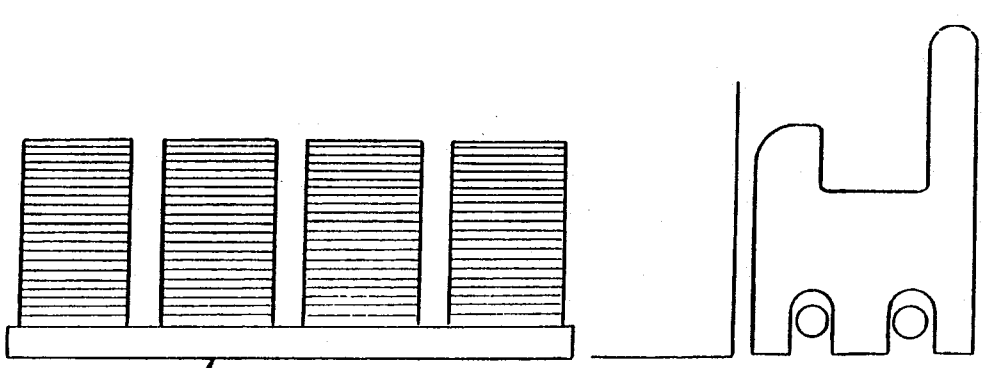
FIG. 3 is a schematic representation of a pallet carrying a number copies of one of the diverse publications thereon.

In accordance with the present invention, a system for co-mailing a plurality of diverse publications includes means for preparing and addressing copies of each of the diverse publications on a binding line 10 (see FIG. 1). The preparing and addressing means includes a plurality of signature feeders 12, a gathering chain 14 for receiving signatures from the feeders 12, a binding machine 16 for binding the signatures into the publications, and an ink jet printer 18 for addressing each of the diverse publications before the copies exit from the binding line 10. In addition, the system includes means for recording mailing information for each of the diverse publications prepared and addressed on the binding line 10.

More specifically, the binding line 10 includes computer means in the form of a central processing unit 20 for controlling the ink jet printer 18 so as to address each of the diverse publications with each of the multiple copies substantially in zip code order. The ink jet printer 18 also applies a machine readable code to every copy of each of the diverse publications in the form of a bar code 22 (see FIG. 5). The bar code 22 is indicative of a zip code and, preferably, a carrier route and/or walk sequence therefor and, while, the bar bode 22 is already in memory in the central processing unit 20, a bar code reader 24 may be provided along the binding line 10 downstream of the ink jet printer 18 (see FIG. 1) for sequentially machine reading in order to continuously verify presence of the correct copy at any point in time, particularly where the binding line 10 continues for some distance beyond the ink jet printer 18; in that case, the bar code reader 24 is positioned at a remote downstream location. The term "zip code" as used herein shall be understood to include zip code and/or carrier route and/or walk sequence. As will be appreciated, the computer means or central processing unit 20 may be entirely separate from the bar code reader 24 although in the illustrated embodiment it is integrally associated with the bar code reader 24 for the purpose of recording mailing information for each of the diverse publications.

More specifically, in the illustrated embodiment the computer means or central processing unit 20 is adapted to sequentially record an address including zip code and, preferably, carrier route for every copy of each of the diverse publications in the exact order of exit from the binding line 10. Thus, the central processing unit 20 comprises not only means for controlling the ink jet printer 18 as required to make it possible to employ selective gathering but also mailing information recording means. Further, the central processing unit 20 and/or the bar code reader 24 is also adapted to sequentially record a count of the exact number of multiple copies for each zip code and, preferably, carrier route for each of the diverse publications prepared on one or more binding lines such as 10.

Figure 2:
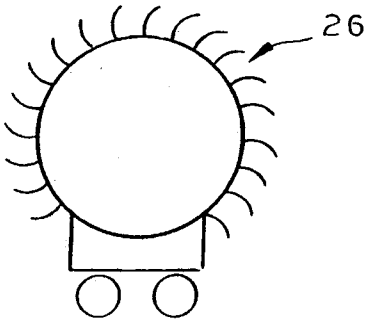
FIG. 2 is a schematic representation of a spirally wound bundle or reel carrying multiple copies of one of the diverse publications thereon.

Referring to FIG. 2, the system also includes means for assembling each of the diverse publications in a predetermined order relative to the order each of the copies exits from one of the binding lines 10. This may advantageously take the form of a separate spirally wound bundle or reel such as 26 for sequentially assembling every copy of each of the diverse publications thereon. By way of example, the spirally wound bundle or reel 26 can be of the type or types manufactured and sold by Muller Martini and/or Ferag although other such devices now or hereafter available may be equally applicable.

Figure 4:
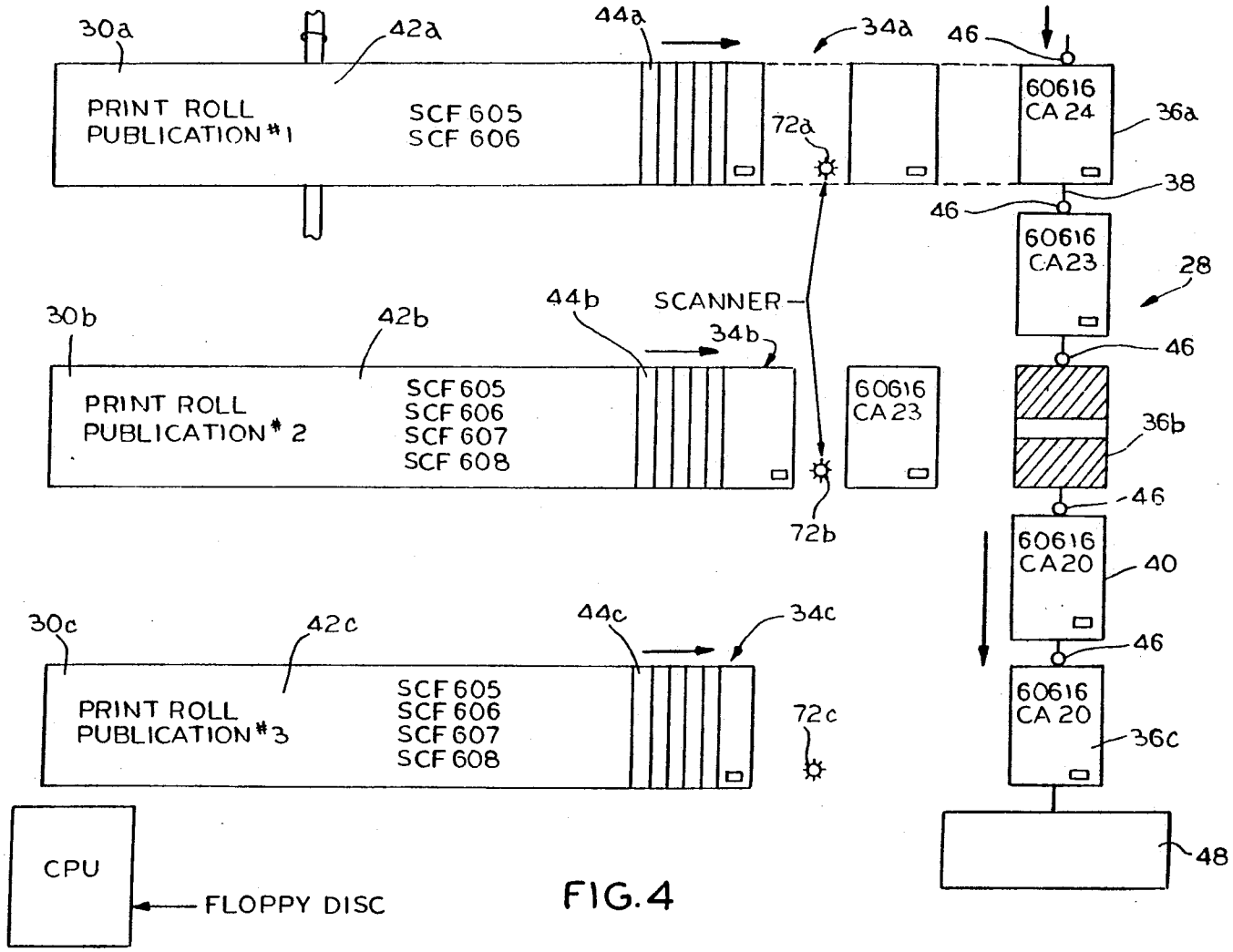
FIG. 4 is a schematic view of a co-mailing line for receiving the numerous copies of the diverse publications from spirally wound bundles or reels.

Referring now to FIG. 4, the system for co-mailing a plurality of diverse publications will also include a co-mailing line 28 for preparing a plurality of diverse publications for co-mailing therefrom. It will thus be appreciated that means will be provided for placing each of the diverse publications in position for feeding each of the copies to the co-mailing line 28 and, by utilizing spirally wound bundles or reels 26, this will require any conventional means for moving the separate spirally wound bundles or reels 26 to a preselected location or locations such as 30*a*, 30*b*, 30*c*, etc. in proximity to the co-mailing line 28 after the diverse publications have been assembled thereon in a predetermined order relative to the order of exit from the binding line or lines 10. As this is being done, the system will also utilize means for assembling the mailing information such as the computer means or central processing unit 32 in a manner that will be more fully described hereinafter.

Still referring to FIG. 4, the central processing unit 32 is adapted to assemble the mailing information for all of the diverse publications to control or otherwise facilitate operation of the co-mailing line 28. This is accomplished in the illustrated embodiment by utilizing one or more floppy discs containing the mailing information for all of the diverse publications to be co-mailed although any other means presently known or hereafter developed may be utilized so long as the mailing information can be assembled therefrom by the central processing unit 32, and it does this to permit the diverse publications to be accumulated for the purpose of co-mailing. In particular, the central processing unit 32 uses the number of copies for each zip code and, preferably, carrier route from all of the diverse publications for sorting to maximize postal discount.

In addition, the co-mailing line 28 includes means for utilizing the assembled mailing information in the central processing unit 32 to feed copies of the diverse publications to the co-mailing line 28. More specifically, the co-mailing line 28 also includes means for accumulating the copies of the diverse publications such as separate publication feeders such as 34*a*, 34*b*, 34*c*, etc., a separate accumulating hopper such as 36*a*, 36*b*, 36*c*, etc. associated with each of the publication feeders 34*a*, 34*b*, 34*c*, etc., and an accumulating conveyor 38 adapted to receive publications from the publication feeders 34*a*, 34*b*, 34*c*, etc. through the accumulating hoppers 36*a*, 36*b*, 36*c*, etc. In this manner, the copies fed to the co-mailing line 28 are accumulated into co-mailing stacks 40 formed by those copies having a common indicia of the assembled mailing information such as zip code and carrier route.

Still referring to FIG. 4, the publication feeders 34*a*, 34*b*, 34*c*, etc. each include a bundle or reel unwind stand such as 42*a*, 42*b*, 42*c*, etc., and a copy separating device such as 44*a*, 44*b*, 44*c*, etc. These components are cooperatively designed to receive the publications from the respective print rolls 30*a*, 30*b*, 30*c*, etc. and feed them to the accumulating hoppers 36*a*, 36*b*, 36*c*, etc. adjacent the accumulating conveyor 38. In this connection, the accumulating conveyor 38 is an indexing conveyor having pins 46 positioned to travel below the accumulating hoppers 36*a*, 36*b*, 36*c*, etc. for receiving copies of the diverse publications contained therein.

As will also be appreciated, the central processing unit 32 is operatively associated with the publication feeders 34*a*, 34*b*, 34*c*, etc. and the accumulating conveyor 38 so as to form the co-mailing stacks 40 in zip code and, preferably, carrier route order. In this manner, the central processing unit 32 is adapted to control or otherwise facilitate the operation of the publication feeders 34*a*, 34*b*, 34*c*, etc. and the accumulating conveyor 38 for forming the co-mailing stacks 40 to have a maximum and a minimum number of copies of the diverse publications.

In the embodiment illustrated in FIG. 4, the system also includes means for preparing the co-mailing stacks 40 of accumulated copies of diverse publications for mailing. This takes the form of a strapping device 48 in the illustrated system whereby each of the co-mailing stacks 40 may be strapped at the end of the co-mailing line 28, i.e., at the end of the accumulating conveyor 38. Alternatively, a shrink wrapping device 50 may be utilized for shrink wrapping each of the co-mailing stacks 40 at the end of the co-mailing line 28 (see FIG. 5).

Figure 5:
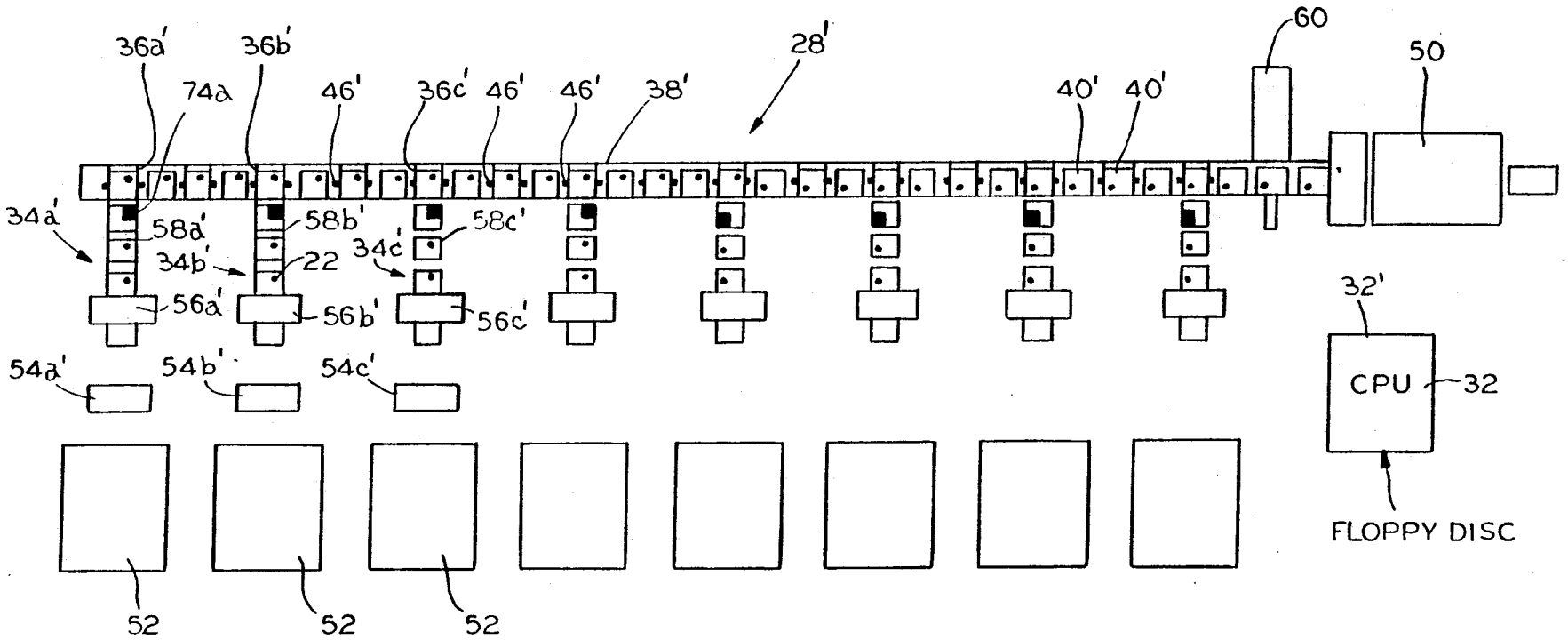
FIG. 5 is a schematic view of a co-mailing line for receiving the numerous copies of the diverse publications from pallets.

Referring specifically to FIG. 5, it will be seen that an alternative form of co-mailing line 28′ has been illustrated. It functions in like fashion to the co-mailing line 28 of FIG. 4 in that it also prepares a plurality of diverse publications for co-mailing therefrom. However, the co-mailing line 28′ is adapted to receive publications from pallets 52 (see, also, FIG. 3).

As shown in FIG. 5, the publication feeders 34*a*′, 34*b*′, etc. each include a pallet load inverter 54*a*′, 54*b*′, etc., a copy inverting gripper 56*a*′, 56*b*′, etc., a transport conveyor 58*a*′, 58*b*′, etc., and an accumulating hopper 36*a*′, 36*b*′, etc. adjacent the accumulating conveyor 38′. The accumulating conveyor 38′ is an indexing conveyor having index pins 46′ and positioned to travel below the accumulating hoppers 36*a*′, 36*b*′, etc., of each of the publication feeders 34*a*′, 34*b*′, etc., for receiving copies of the diverse publications contained therein. As with the embodiment illustrated in FIG. 4, a central processing unit 32′ is operatively associated with the publication feeders 34*a*′, 34*b*′, etc. and the accumulating conveyor 38′ for forming co-mailing stacks 40′ in zip code and, preferably, carrier route order.

As will be seen, the co-mailing line 28′ may include a diverter 60 downstream of the publication feeders 34*a*′, 34*b*′, etc. It also will be seen that, just downstream of the diverter 60, a shrink wrapping device 50 may be provided for shrink wrapping each of the co-mailing stacks 40 at the end of the co-mailing line 28′. Alternatively, a strapping device such as 48 may be provided for strapping each of the co-mailing stacks 40′ at the end of the co-mailing line 28′ (see FIG. 4).

Figure 6:
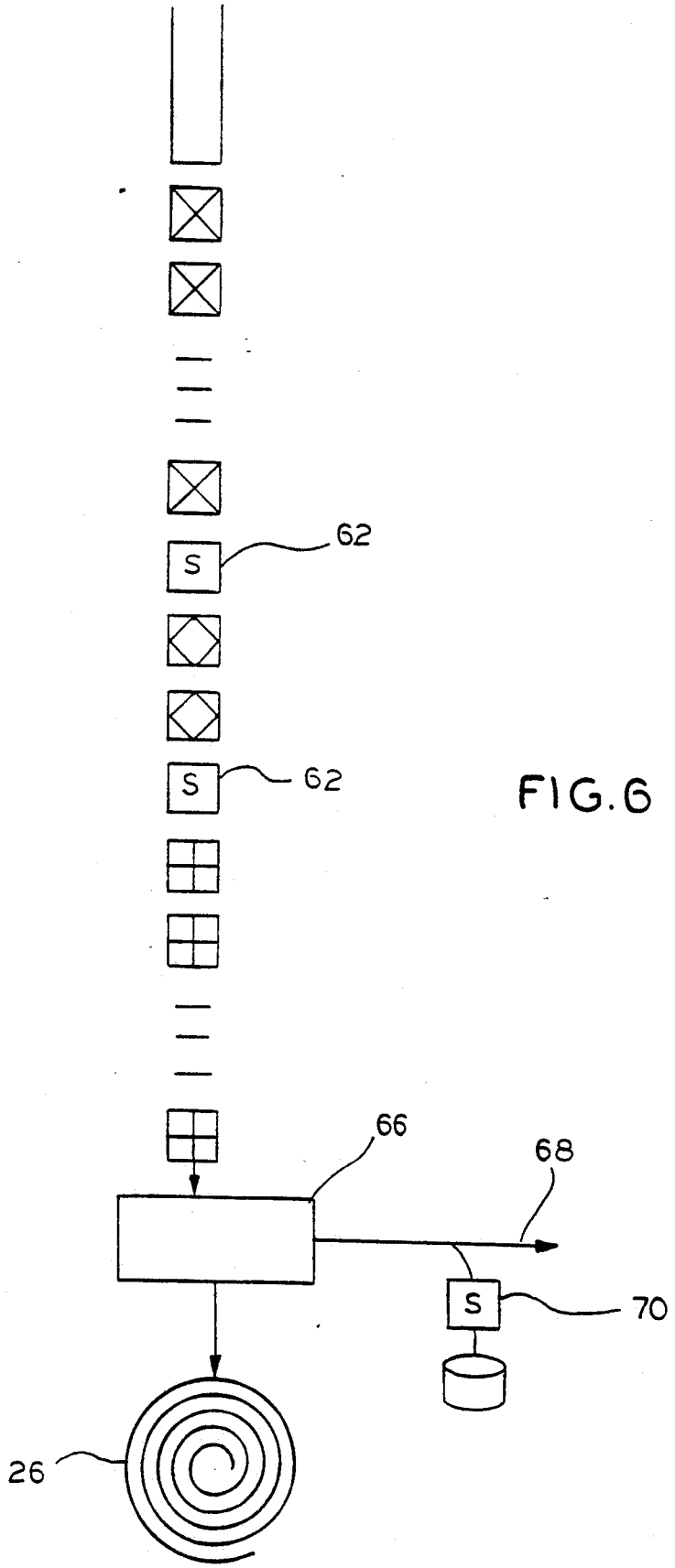
FIG. 6 is a schematic view of yet another aspect of the binding line of FIG. 1.

Comparing FIGS. 1 and 6, the ink jet printer 18 may instead apply a machine readable code to a zip code separator book 62. The zip code separator book may be placed between copies of diverse publications destined for different zip codes by means of a separate feeder 64. The machine readable code may comprise a bar code such as 22 placed in a preselected location on each of the zip code separator books 62. The bar code 22 is indicative of a particular zip code for every copy of each of the diverse publications following each of the zip code separator books 62. With this arrangement, the machine readable code need not be applied to every copy of each of the diverse publications.

Instead, the central processing unit 20 or the bar code reader 24 may simply count the number of copies upstream of each of the zip code separator books 62 by first sequentially machine reading the bar codes 22. The central processing unit 20 or the bar code reader 24 can then sequentially record a count of the number of copies for each zip code for each of the diverse publications. As will be appreciated, the zip code separator books 62 should stay with the copies of the diverse publications as they are assembled onto, e.g., a spirally wound bundle or reel 26 following exit from the binding line 10.

Referring to FIG. 6, a typical binding line will include a switching device 66 for determining whether the publication being prepared on the line will be directed to a spirally wound bundle or reel 26 or processed in a normal manner for mailing as shown generally at 68. In the event of normal processing, the copies of the publication are delivered to a mailing station and the zip code separator books 62 can be removed by utilizing a diverter 70 provided downstream of the switching device 66 in the illustrated embodiment.

If desired, the copies of the publications can be individually marked in still another manner. In particular, instead of ink jet printing, a label with zip code identifying indicia may be placed on the copies wherein the identifying indicia is capable of being read and understood by any available means. In other words, the particular means of marking and reading can take various forms.

In actual practice, the diverse publications may well be prepared on more than one binding line. They can, in fact, be prepared on binding lines located at different locations wherein the publications are then transported on either spirally wound bundles or reels 26 or pallets 52 to a co-mailing line 28 or 28'. Additionally, some or all of the diverse publications may be selectively bound and/or internally customized.

As will now be appreciated, the ink jet printer 18 may address every copy of each of the diverse publications substantially in zip code and carrier route order and, in one form of the invention, apply a machine readable code to every copy of each of the diverse publications on the binding line 10 indicative of a zip code and carrier route therefor. The machine readable code advantageously comprises a bar code indicative of a zip code and carrier route for every copy of each of the diverse publications and the bar code reader 24 downstream of the ink jet printer 18 sequentially machine reads the bar codes for every copy of each of the diverse publications exiting the binding line 10. Since the central processing unit 20 is integrally associated with the bar code reader 24, a zip code and carrier route is sequentially recorded for every copy of each of the diverse publications in a predetermined order which may be the exact order of exit from the binding line 10 and a count of the number of copies for each zip code and carrier route for each of the diverse publications is also sequentially recorded.

As illustrated in both FIG. 4 and FIG. 5, a common co-mailing line 28 or 28' is provided for all of the diverse publications. It will also be appreciated that the co-mailing line 28 or 28' includes a separate publication feeder 34*a* or 34*a*', 34*b* or 34*b*', etc. for each of the diverse publications and an accumulating conveyor 38 or 38' adapted to receive publications from the publication feeders 34*a* or 34*a*', 34*b* or 34*b*', etc. In this connection, the accumulating conveyor 38 or 38' passes an exit point of each of the publication feeders 34*a* or 34*a*', 34*b* or 34*b*', etc.

As previously discussed, the central processing unit 32 or 32' utilizes the assembled mailing information provided by floppy disc or magnetic tape or other suitable means for the purpose of feeding copies of the diverse publications to the co-mailing line 28 or 28'. The central processing unit 32 or 32' is adapted to control the co-mailing line 28 or 28' whereby the diverse publications are fed in a predetermined or appropriate sequence by the publication feeders 34*a* or 34*a*', 34*b* or 34*b*', etc. to the accumulating conveyor 38 or 38'. By reason of the control of the central processing unit 32 or 32', copies of the diverse publications are fed to the co-mailing line 28 or 28' substantially in zip code and carrier route order.

In another respect, the present invention is directed to a method of co-mailing a plurality of diverse publications including the step of preparing and addressing copies of each of the diverse publications on the same or different binding line(s). Next, mailing information is recorded for each of the diverse publications so prepared and addressed on the binding line(s). Then, each of the diverse publications is assembled in a predetermined order as the copies exit from the binding line(s) following which each of the diverse publications is placed in position for feeding each of the copies to a co-mailing line in a predetermined order relative to the order of exit from the binding line(s). Next, mailing information for all of the diverse publications is assembled to control or otherwise facilitate operation of the co-mailing line by permitting the diverse publications to be accumulated for co-mailing purposes. Then, assembled mailing information is utilized to feed copies of the diverse publications to the co-mailing line following which the copies are accumulated into co-mailing stacks formed by copies of the diverse publications having a common indicia of assembled mailing information. Finally, the method includes the step of preparing the co-mailing stacks of accumulated copies of diverse publications for mailing.

In accordance with the invention, the preparing and addressing step includes preparing at least one of the diverse publications with selectively bound and/or internally customized copies. This step also includes addressing each of the diverse publications with copies substantially in zip code order. Further, the preparing and addressing step includes applying a machine readable code to every copy of each of the diverse publications or, alternatively, to a zip code separator book.

In this connection, the machine readable code comprises a bar code indicative of a zip code for every copy of each of the diverse publications. The preparing and addressing step thus includes affixing an address to every copy of each of the diverse publications and the bar code either to every copy of each of the diverse publications or, alternatively, to a zip code separator book upstream of copies for that zip code. Accordingly, the recording step includes sequentially machine reading a bar code for every copy of each of the diverse publications exiting the binding line.

Preferably, the recording step includes sequentially recording an address including zip code for every one of multiple copies of each of the diverse publications. The addresses and zip codes are then recorded in the exact order each of the multiple copies of the diverse publications exits from the binding line. Alternatively, the recording step may include sequentially recording a count of the number of multiple copies for each zip code for each of the diverse publications.

With the inventive method, every copy of each of the diverse publications may be prepared and addressed at a different time and/or on a different binding line. The publication assembling step may then include sequentially assembling every copy of each of the diverse publications on a separate spirally wound bundle or reel or, alternatively, onto separate pallets. When utilizing separate spirally wound bundles or reels, each of them is placed in a preselected location in proximity to the co-mailing line.

As for the mailing information assembling step, it includes determining the number of copies for each zip code for each of the diverse publications. The mailing information assembling step then includes using the number of copies for each zip code to maximize postal discount, the utilizing step includes feeding copies of each of the diverse publications to the co-mailing line substantially in zip code order, and the accumulating step includes sequentially accumulating copies of each of the diverse publications into co-mailing stacks in zip code order. Advantageously, the co-mailing stacks are assembled so as to have a maximum and a minimum number of copies of the diverse publications.

In one form of the invention, the publication assembling step includes sequentially assembling copies of each of the diverse publications onto separate pallets. The pallets for each of the diverse publications is then placed in a preselected location in proximity to the co-mailing line. Next, the pallets are each inverted so that copies of each of the diverse publications may be fed first-in, first-out to the co-mailing line.

As for the addressing step, it may alternatively include applying a machine readable code to a zip code separator book placed on the binding line between copies of the diverse publications destined for different zip codes. The machine readable code may advantageously comprise a bar code placed in a preselected location on each of the zip code separator books so as to be indicative of a particular zip code for every copy of each of the diverse publications preceding each of the zip code separator books. The recording step may then include counting the number of copies upstream of each of the zip code separator books which may be done either electronically or mechanically, sequentially machine reading the bar codes on each of the zip code separator books, and sequentially recording a count of the number of copies for each zip code for each of the diverse publications which, again, may be done either electronically or mechanically. Additionally, the inventive method includes the step of removing each of the zip code separator books from the copies of the diverse publications upstream of the point where the copies are accumulated into co-mailing stacks.

As will be appreciated from the foregoing, a record of the exact number of publications for each zip code and carrier route is recorded on a floppy disk or on magnetic tape or by any other suitable means which will occur, for instance, at the central processing unit 20 or the bar code reader 24 illustrated in FIG. 1 in the manner previously described hereinabove. It should be understood that, by the phrase "other suitable means", it is meant to encompass not only other presently available means for performing the function of a floppy disc or magnetic tape, such as RF signals and the like, but also potential future developments that could similarly perform the function performed at present by a floppy disc or magnetic tape. When each of the diverse publications has been prepared on one of the binding lines 10, the corresponding floppy disk or magnetic tape or other suitable means will be removed from the central processing unit 20 or the bar code reader 24 for use in the central processing unit 32 or 32' of the co-mailing line 28 or 28'.

After binding, the publications may each be rolled up on separate spirally wound bundles or reels such as 26. The spirally wound bundles or reels 26 are then identified by three digit zip code (SCF) and stored for later co-mailing. As will be appreciated, the co-mailing process begins by bringing the spirally wound bundles or reels 26 to the co-mailer 28.

At this point, the floppy disk or magnetic tape or other suitable means containing data generated on the binding line 10 for each publication is put into the memory of the central processing unit 32. The central processing unit 32 program-assembles the information from the floppy disks or magnetic tapes for each of the diverse publications to determine the levels of postal sorting possible for each zip code and, preferably, carrier route by the available quantities. Next, the co-mailer 28 unwinds the spirally wound bundles or reels 26 and, because the copies are in a shingled stream, they are fed easily and scanned for the bar code 22 as at 72*a*, 72*b*, 72*c*, etc.

As will be appreciated, the copies will normally be wound on the bundles or reels 26 in last-in-first-out (LIFO), i.e., reverse order of exit from the binding line, fashion although this can be reversed if desired. One means of reversing is by first winding the copies onto one bundle or reel 26 and from there onto another bundle or reel 26 which will then place the copies in first-in-first-out (FIFO), i.e., exact order of exit from the binding line, fashion. Depending upon whether the copies exit the spirally wound bundles or reels 26 in LIFO or FIFO fashion, the central processing unit 32 or 32' on the co-mailing line 28 or 28' may be programmed to utilize the data from the floppy disc or magnetic tape or other suitable means in a manner that will be within the skill of those in the art.

In this connection, scanning the bar codes 22 at this point has three very distinct functions. First, it identifies that a particular zip code and, preferably, carrier route has arrived. The central processing unit 32 already knows how many copies to expect and has provided space on the indexing conveyor 38 for them. Second, the number of copies being delivered to each of the accumulating hoppers 36*a*, 36*b*, 36*c*, etc. will be counted. The minimum quantity for a direct package as second class mail is six which is why six or more copies for each space on the indexing conveyor will be used whenever possible. Third, the information will be used to provide an audit trail for the post office. As will be appreciated, any number of separate publication feeders such as 34a, 34b, 34c, etc. can be designed into the system.

As previously discussed, the indexing conveyor 38 has a path of movement beneath the accumulating hoppers 36a, 36b, 36c, etc. The accumulating hoppers 36a, 36b, 36c, etc. can thus drop their contents onto the indexing conveyor 38 upon command of the central processing unit 32 where they are engaged by the index pins 46. When the co-mailing stacks 40 reach the strapping device 48 or the shrink wrapping device 50, they can be packaged as previously discussed.

In the embodiment illustrated in FIG. 5, the binding and addressing of the publications will be done in a conventional manner. The publications may then merely be counted into convenient sized lifts and piled down onto a pallet 52 in an identified, specific sequence such that, once the pallet load is complete, the load can be inverted by means of a load inverter 54a', 54b', etc. As a result, the first book produced will be at the top of the load with the label down, i.e., the books will be oriented for feeding in FIFO fashion.

Next, the lifts of books will be fed into the co-mailer 28' first-in, first-out with the first lift in the pallet loading sequence being fed into the inverting gripper 56a', 56b', etc. The inverting gripper 56a', 56b', etc. will turn the respective lift, label up again. As a result, the first book produced is permitted to enter first onto the indexing conveyor 38' through the accumulating hopper 36a', 36b', etc.

As will be appreciated, the floppy disk or magnetic tape or other means containing the zip code and, preferably, carrier route counts made during the addressing step is read by the central processing unit 32' and, depending upon the quantity in each zip code and carrier route, a number of spaces will be allocated on the indexing conveyor 38' for that particular zip code and carrier route.

As each copy is fed to the accumulating hopper 36a', the bar code is read by the reader 74a to identify that copy's zip code and carrier route. The copy proceeds to the accumulating hopper 36a' after which the next copy is read and, if it is of the same zip code and carrier route as the preceding copy, it too proceeds to the accumulating hopper 36a'. As will be appreciated, this continues until the zip code and carrier route changes or as directed by the central processing unit 32'.

Of course, the operation will be slightly different when using the zip code separator books 62. Then, the bar code on the zip code separator book 62 will be read following which the zip code separator book 62 will be diverted by any conventional means and the count of copies for the zip code represented by that bar code will be fed to the accumulating hopper 36a'. As will be appreciated, the bar code on the next zip code separator book 62 will then be read, etc.

At the point immediately following the feeding of the correct number of copies to the accumulating hopper 36a', the transport conveyor 58a' stops moving and the books accumulated in the accumulating hopper 36a' are dropped onto the indexing conveyor 38'.

Once this occurs, the indexing conveyor 38' advances to the next station or accumulating hopper 36b'. The accumulating hopper 36b' will have been accumulating copies for the first zip code and carrier route sort and, thus, when the indexing conveyor 38' indexes, the accumulating hopper 36b' drops its contents on top of the previous drop from the accumulating hopper 36a'. During this time, the accumulating hopper 36a' is already accumulating the next drop.

In this connection, the central processing unit 32' compares the bar code being read by the reader such as 74a with the bar code that has been assigned to the next space on the indexing conveyor 38' to coordinate the dropping of accumulated publications onto the conveyor. In other words, it either causes the contents of the accumulating hopper such as 36a' to drop or holds it until the correct space on the indexing conveyor 38' arrives. Preferably, each of the transport conveyors such as 58a' operates independently to deliver publications to the corresponding accumulating hopper 36a' to accumulate its next sortation as soon as the previous contents have been dropped in the proper space on the indexing conveyor 38'.

As will be appreciated, the indexing conveyor 38' does not advance until selected ones or all of the accumulating hoppers 36a', 36b', etc. have dropped their contents into the corresponding spaces beneath on the indexing conveyor 38'. Since each transport conveyor 58a' and accumulating hopper 36a' accumulates independently anticipating its next drop, the time for each stop of the indexing conveyor 38' will be minimal. As a result, the net output of the co-mailer 28' should be in the 30,000 books per hour range while each transport conveyor such as 58a' and accumulating hopper such as 36a' need operate at only about sixty to one hundred books per minute.

As will also now be appreciated, the central processing unit 32 or 32' can be operatively associated with the corresponding readers 72a, 72b, etc or 74a, 74b, etc. The readers 72a, 72b, etc. or 74a, 74b, etc. produce an exact count of copies of each of the diverse publications by zip code and/or carrier route which information may be compared with the expected count in the central processing unit 32 or 32' and, in this manner, the co-mailing system includes a closed loop error detection system which may also make the co-mailing system self-correcting due to the fact that the central processing unit 32 or 32' is also operatively associated with the publication feeders 34a, 34b, etc. or 34a', 34b', etc as well as the conveyor 38 or 38'. As a result, the co-mailing system has an inherent error detection and correction capability which can be particularly useful in the event, e.g., of dropping or adding a bit in either certain data critical parts of the system, including the stored mailing information.

While in the foregoing there have been set forth preferred embodiments of the invention, it will be appreciated that the details herein given may be varied by those skilled in the art without departing from the true spirit and scope of the appended claims.

We claim:

1. A method of co-mailing a plurality of diverse publications, comprising the steps of:

preparing and addressing copies of each of said diverse publications on a binding line;

recording mailing information for each of said diverse publications prepared and addressed on said binding line;

assembling each of said diverse publications in a predetermined order as said copies exit from said binding line;

placing each of said diverse publications in position for feeding each of said copies to a co-mailing line, said diverse publications each being placed for feeding each of said copies in a predetermined order relative to the order of exit from said binding line;

assembling said mailing information for all of said diverse publications to control or otherwise facilitate operation of said co-mailing line, said mailing information being assembled to permit said diverse publications to be accumulated for co-mailing purposes;

utilizing said assembled mailing information to feed copies of said diverse publications to said co-mailing line;

accumulating said copies of said diverse publications fed to said co-mailing line into co-mailing stacks, said co-mailing stacks being formed by copies of said diverse publications having a common indicia of said assembled mailing information; and preparing said co-mailing stacks of accumulated copies of diverse publications for mailing.

2. The method of claim 1 wherein said preparing and addressing step includes preparing at least one of said diverse publications with selectively bound copies.

3. The method of claim 1 wherein said preparing and addressing step includes preparing at least one of said diverse publications with internally customized copies.

4. The method of claim 1 wherein said preparing and addressing step includes addressing each of said diverse publications with copies substantially in zip code order.

5. The method of claim 1 wherein said preparing and addressing step includes applying a machine readable code to every copy of each of said diverse publications.

6. The method of claim 5 wherein said machine readable code comprises a bar code indicative of a zip code for every copy of each of said diverse publications.

7. The method of claim 6 wherein said preparing and addressing step includes affixing an address and said bar code to every copy of each of said diverse publications.

8. The method of claim 7 wherein said recording step includes sequentially machine reading said bar codes for every copy of each of said diverse publications exiting said binding line.

9. The method of claim 1 wherein said recording step includes sequentially recording an address including zip code for every copy of each of said diverse publications.

10. The method of claim 9 wherein said addresses and zip codes are recorded in the exact order each copy of each of said diverse publications exits from said binding line.

11. The method of claim 1 wherein said recording step includes sequentially recording an exact count of the number of copies for each zip code for each of said diverse publications.

12. The method of claim 1 wherein at least one copy of said diverse publications is prepared and addressed at a different time and/or on a different binding line.

13. The method of claim 1 wherein said publication assembling step includes sequentially assembling every copy of each of said diverse publications on a separate spirally wound bundle or reel.

14. The method of claim 13 wherein said placing step includes placing each of said separate spirally wound bundles or reels in a preselected location in proximity to said co-mailing line.

15. The method of claim 1 wherein said mailing information assembling step includes determining the number of copies for each zip code for each of said diverse publications.

16. The method of claim 15 wherein said mailing information assembling step includes using the number of copies for each zip code to maximize postal discount.

17. The method of claim 15 wherein said utilizing step includes feeding copies of each of said diverse publications to said co-mailing line substantially in zip code order.

18. The method of claim 17 wherein said accumulating step includes sequentially accumulating copies of each of said diverse publications into co-mailing stacks in zip code order.

19. The method of claim 18 wherein said co-mailing stacks are assembled so as to have a maximum and a minimum number of copies of said diverse publications.

20. The method of claim 1 wherein said preparing for mailing step includes either strapping or shrink wrapping each of said co-mailing stacks at the end of said co-mailing line.

21. The method of claim 1 wherein said publication assembling step includes sequentially assembling copies of each of said diverse publications onto separate pallets.

22. The method of claim 21 wherein said placing step includes placing said pallets for each of said diverse publications in a preselected location in proximity to said co-mailing line.

23. The method of claim 22 wherein each of said pallets is inverted so that copies of each of said diverse publications may be fed first-in-first-out to said co-mailing line.

24. The method of claim 1 wherein said preparing and addressing step includes applying a machine readable code to a zip code separator book, and placing said zip code separator book on said binding line between copies of said diverse publications destined for different zip codes.

25. The method of claim 24 wherein said machine readable code comprises a bar code placed in a preselected location on each of said zip code separator books, said bar code being indicative of a particular zip code for every copy of each of said diverse publications upstream of each of said zip code separator books.

26. The method of claim 25 wherein said recording step includes sequentially machine reading said bar codes on each of said zip code separator books, counting the number of copies upstream of each of said zip code separator books, and sequentially recording an exact count of the number of copies for each zip code for each of said diverse publications.

27. The method of claim 26 including the step of removing each of said zip code separator books from said copies of said diverse publications upstream of the point where said copies of said diverse publications are accumulated into said co-mailing stacks.

28. A method of co-mailing a plurality of diverse publications, comprising the steps of:

preparing and addressing multiple copies of each of said diverse publications on a binding line, said preparing and addressing step including preparing at least one of said diverse publications with personalized copies, said personalized copies being selectively bound and/or internally customized;

recording mailing information for each of said diverse publications prepared and addressed on said binding line, said mailing information being recorded such that said recording step includes sequentially recording an exact count by zip code;

assembling each of said diverse publications in a predetermined order as said multiple copies exit from said binding line;

placing each of said diverse publications in position for feeding each of said multiple copies to a co-mailing line, said diverse publications each being placed for feeding each of said multiple copies in a predetermined order relative to the order of exit from said binding line;

assembling said mailing information for all of said diverse publications to control or otherwise facilitate operation of said co-mailing line, said mailing information being assembled to permit said diverse publications to be accumulated for co-mailing purposes, said mailing information assembling step including determining the number of copies for each zip code for said diverse publications;

utilizing said assembled mailing information for the purpose of feeding copies of said diverse publications to said co-mailing line, said utilizing step including the feeding of copies of said diverse publications to said co-mailing line substantially in zip code order;

accumulating said copies of said diverse publications fed to said co-mailing line into co-mailing stacks, said co-mailing stacks being formed by copies of said diverse publications having a common indicia of said assembled mailing information, said accumulating step including sequentially accumulating copies of said diverse publications into co-mailing stacks in zip code order; and preparing said co-mailing stacks of accumulated copies of diverse publications for mailing.

29. The method of claim 28 wherein said preparing and addressing step includes addressing every copy of each of said diverse publications substantially in zip code and carrier route order and applying a machine readable code to every copy of each of said diverse publications on said binding line indicative of a zip code and carrier route therefor.

30. The method of claim 29 wherein said machine readable code comprises a bar code indicative of a zip code and carrier route for every copy of each of said diverse publications and said preparing and addressing step includes affixing an address and said bar code to every copy of each of said diverse publications on said binding line.

31. The method of claim 30 wherein said recording step includes sequentially machine reading said bar codes for every copy of each of said diverse publications exiting said binding line, said recording step also including the step of sequentially recording a zip code and carrier route for every copy of each of said diverse publications.

32. The method of claim 31 wherein said recording step includes recording said zip codes and carrier routes in the exact order each copy of each of said diverse publications exits said binding line, said recording step also including sequentially recording an exact count of the number of copies for each zip code and carrier route for each of said diverse publications.

33. The method of claim 28 wherein said assembling step includes sequentially assembling every copy of each of said diverse publications on a separate spirally wound bundle or reel and said placing step includes placing each of said separate spirally wound bundles or reels in a preselected location for feeding said copies of said diverse publications to said co-mailing line.

34. The method of claim 28 wherein said mailing information assembling step includes determining the number of copies for each zip code and carrier route for each of said diverse publications, said mailing information assembling step also including using the number of copies for each zip code and carrier route in order to maximize postal discount.

35. The method of claim 34 wherein said utilizing step includes feeding copies of each of said diverse publications to said co-mailing line substantially in zip code and carrier route order, said accumulating step including sequentially accumulating copies of each of said diverse publications into co-mailing stacks in zip code and carrier route order.

36. The method of claim 28 wherein said publication assembling step includes sequentially assembling copies of each of said diverse publications onto separate pallets, said placing step including the placing of said pallets for each of said diverse publications in a preselected location for feeding said copies of said diverse publications to said co-mailing line.

37. The method of claim 28 wherein said preparing and addressing step includes applying a machine readable code to a zip code separator book, and placing said zip code separator book on said binding line between copies of said diverse publications destined for different zip codes.

38. The method of claim 37 wherein said machine readable code comprises a bar code placed in a preselected location on each of said zip code separator books, said bar code being indicative of a particular zip code for every copy of each of said diverse publications upstream of each of said zip code separator books.

39. The method of claim 38 wherein said recording step includes sequentially machine reading said bar codes on each of said zip code separator books and counting the number of copies upstream of each of said zip code separator books to thereby sequentially record an exact count of the number of copies for each zip code for each of said diverse publications.

40. The method of claim 39 including the step of removing each of said zip code separator books from said copies of said diverse publications upstream of the point where said copies of said diverse publications are accumulated into said co-mailing stacks.

41. A method of co-mailing a plurality of diverse publications, comprising the steps of:

preparing and addressing multiple copies of each of said diverse publications on one or more binding lines, said preparing and addressing step including preparing at least one of said diverse publications with personalized copies, said personalized copies being selectively bound and/or internally customized;

recording mailing information for each of said diverse publications prepared and addressed on said binding line(s) in the exact order each of said multiple copies exits therefrom including sequentially recording an exact count by zip code and carrier route;

assembling each of said diverse publications in a reverse order relative to the order of exit of each of said multiple copies from said binding line(s), said assembling step including sequentially assembling every copy of each of said diverse publications on a separate spirally wound bundle or reel;

providing a common co-mailing line for all of said diverse publications, said co-mailing line including a separate publication feeder for each of said diverse publications and an accumulating conveyor adapted to receive publications from said publication feeders, said accumulating conveyor passing an exit point of each of said publication feeders;

placing each of said diverse publications in position for feeding each of said multiple copies to said co-mailing line in a reverse order relative to the order of exit from said binding line(s), said placing step including separately placing each of said separate spirally wound bundles or reels in a preselected location relative to one of said publication feeders;

assembling said mailing information for all of said diverse publications to permit said diverse publications to be accumulated for co-mailing purposes, said mailing information assembling step including determining the exact number of copies for each zip code and carrier route for said diverse publications;

utilizing said assembled mailing information for the purpose of feeding copies of said diverse publications to said co-mailing line, said assembled mailing information being utilized to control or otherwise facilitate the operation of said co-mailing line whereby said diverse publications are fed in a predetermined sequence by said publication feeders to said accumulating conveyor, said utilizing step including feeding copies of said diverse publications to said co-mailing line substantially in zip code and carrier route order;

accumulating said copies of said diverse publications fed to said accumulating conveyor by said publication feeders into co-mailing stacks, said co-mailing stacks being formed by copies of said diverse publications having a common indicia of said assembled mailing information including zip code and carrier route therefor, said accumulating step including sequentially accumulating copies of said diverse publications into co-mailing stacks in zip code and carrier route order; and preparing said co-mailing stacks of accumulated copies of diverse publications for mailing.

42. The method of claim 41 wherein said preparing and addressing step includes addressing every copy of each of said diverse publications substantially in zip code and carrier route order and applying a machine readable code to every copy of each of said diverse publications on said binding line indicative of a zip code and carrier route therefor.

43. The method of claim 42 wherein said machine readable code comprises a bar code indicative of a zip code and carrier route for every copy of each of said diverse publications and said preparing and addressing step includes affixing an address and said bar code to every copy of each of said diverse publications on said binding line(s).

44. The method of claim 43 wherein said recording step includes sequentially machine reading said bar codes for every copy of each of said diverse publications exiting said binding line(s), said recording step also including the step of sequentially recording a zip code and carrier route for every copy of each of said diverse publications.

45. The method of claim 44 wherein said recording step includes recording said zip codes and carrier routes in the exact order each copy of each of said publications exits said binding line(s), said recording step also including sequentially recording an exact count of the number of copies for each zip code and carrier route for each of said diverse publications.

46. The method of claim 41 wherein said mailing information assembling step includes determining the number of copies for each zip code and carrier route for each of said diverse publications, said mailing information assembling step also including using the number of copies for each zip code and carrier route in order to maximize postal discount.

47. The method of claim 43 wherein said publication feeders each include a bundle or reel unwind stand, a copy separating device for forming a shingled stream of copies, a bar code reader, and an accumulating hopper adjacent said accumulating conveyor.

48. The method of claim 47 wherein said accumulating conveyor is an indexing conveyor positioned to travel below said accumulating hoppers of each of said publication feeders for receiving copies of said diverse publications contained therein.

49. The method of claim 48 wherein said mailing information assembling and utilizing steps employ a central processing unit operatively associated with said accumulating conveyors and each of said publication feeders.

50. The method of claim 41 wherein said preparing and addressing step includes applying a machine readable code to a zip code separator book, and placing said zip code separator book on said binding line between copies of said diverse publications destined for different zip codes.

51. The method of claim 50 wherein said machine readable code comprises a bar code placed in a preselected location on each of said zip code separator books, said bar code being indicative of a particular zip code for every copy of each of said diverse publications upstream of each of said zip code separator books.

52. The method of claim 51 wherein said recording step includes sequentially machine reading said bar codes on each of said zip code separator books and counting the number of copies upstream of each of said zip code separator books to thereby sequentially record an exact count of the number of copies for each zip code for each of said diverse publications.

53. The method of claim 52 including the step of removing each of said zip code separator books from said copies of said diverse publications upstream of the point where said copies of said diverse publications are accumulated into said co-mailing stacks.

54. A method of co-mailing a plurality of diverse publications, comprising the steps of:

preparing and addressing multiple copies of each of said diverse publications on one or more binding line(s), said preparing and addressing step including preparing at least one of said diverse publications with personalized copies, said personalized copies being selectively bound and/or internally customized;

recording mailing information for each of said diverse publications prepared and addressed on said binding line(s) in the exact order each of said multiple copies exits therefrom including sequentially recording an exact count by zip code and carrier route;

assembling each of said diverse publications in a reverse order relative to the order each of said multiple copies exits from said binding line(s), said assembling step including sequentially assembling every copy of each of said diverse publications onto separate pallets;

providing a common co-mailing line for all of said diverse publications, said co-mailing line including a separate publication feeder for each of said diverse publications and an accumulating conveyor adapted to receive publications from said publication feeders, said accumulating conveyor passing an exit point of each of said publication feeders placing each of said diverse publications in position for feeding each of said multiple copies to a co-mailing line in the exact order of exit from said binding line(s), said placing step including separately inverting and placing each of said pallets in a preselected location relative to one of said publication feeders;

assembling said mailing information for all of said diverse publications to permit said diverse publications to be accumulated for co-mailing purposes, said mailing information assembling step including determining the exact number of copies for each zip code and carrier route for said diverse publications;

utilizing said assembled mailing information for the purpose of feeding copies of said diverse publications to said co-mailing line, said assembled mailing information being utilized to control or otherwise facilitate the operation of said co-mailing line whereby said diverse publications are fed in a predetermined sequence by said publication feeders to said accumulating conveyor, said utilizing step including feeding copies of said diverse publications to said co-mailing line substantially in zip code and carrier route order;

accumulating said copies of said diverse publications fed to said accumulating conveyor by said publication feeders into co-mailing stacks, said co-mailing stacks being formed by copies of said diverse publications having a common indicia of said assembled mailing information including zip code and carrier route therefor, said accumulating step including sequentially accumulating copies of said diverse publications into co-mailing stacks in zip code and carrier route order; and preparing said co-mailing stacks of accumulated copies of diverse publications for mailing.

55. The method of claim 54 wherein said preparing and addressing step includes addressing every copy of each of said diverse publications substantially in zip code and carrier route order and applying a machine readable code to every copy of each of said diverse publications on said binding line(s) indicative of a zip code and carrier route therefor.

56. The method of claim 55 wherein said machine readable code comprises a bar code indicative of a zip code and carrier route for every copy of each of said diverse publications and said preparing and addressing step includes affixing an address and said bar code to every copy of each of said diverse publications on said binding line(s).

57. The method of claim 56 wherein said recording step includes sequentially machine reading said bar codes for every copy of each of said diverse publications exiting said binding line(s), said recording step also including the step of sequentially recording a zip code and carrier route for every copy of each of said diverse publications.

58. The method of claim 57 wherein said recording step includes recording said zip codes and carrier routes in the exact order each copy of each of said publications exits said binding line(s), said recording step also including sequentially recording an exact count of the number of copies for each zip code and carrier route for each of said diverse publications.

59. The method of claim 54 wherein said mailing information assembling step includes determining the number of copies for each zip code and carrier route for each of said diverse publications, said mailing information assembling step also including using the number of copies for each zip code and carrier route in order to maximize postal discount.

60. The method of claim 54 wherein said publication feeders each include a pallet load inverter, a copy inverting gripper, a transport conveyor, a bar code reader, and an accumulating hopper adjacent said accumulating conveyor.

61. The method of claim 60 wherein said accumulating conveyor is an indexing conveyor positioned to travel below said accumulating hoppers of each of said publication feeders for receiving copies of said diverse publications contained therein.

62. The method of claim 61 wherein said mailing information assembling and utilizing steps employ a central processing unit operatively associated with said accumulating conveyors and each of said publication feeders.

63. The method of claim 54 wherein said preparing and addressing step includes applying a machine readable code to a zip code separator book, and placing said zip code separator book on said binding line between copies of said diverse publications destined for different zip codes.

64. The method of claim 63 wherein said machine readable code comprises a bar code placed in a preselected location on each of said zip code separator books, said bar code being indicative of a particular zip code for every copy of each of said diverse publications upstream of each of said zip code separator books.

65. The method of claim 64 wherein said recording step includes sequentially machine reading said bar codes on each of said zip code separator books and counting the number of copies upstream of each of said zip code separator books to thereby sequentially record an exact count of the number of copies for each zip code for each of said diverse publications.

66. The method of claim 65 including the step of removing each of said zip code separator books from said copies of said diverse publications upstream of the point where said copies of said diverse publications are accumulated into said co-mailing stacks.

67. A system for co-mailing a plurality of diverse publications, comprising:

means for preparing and addressing copies of each of said diverse publications on a binding line;

means for recording mailing information for each of said diverse publications prepared and addressed by said preparing and addressing means on said binding line;

means for assembling each of said diverse publications in a predetermined order as said copies exit from said binding line;

a co-mailing line for preparing a plurality of diverse publications for co-mailing therefrom;

means for placing each of said diverse publications in position for feeding each of said copies to said co-mailing line in a predetermined order relative to the order of exit from said binding line;

means for assembling said mailing information for all of said diverse publications to control or otherwise facilitate operation of said co-mailing line by permitting said diverse publications to be accumulated for co-mailing purposes;

means for utilizing said assembled mailing information to feed copies of said diverse publications to said co-mailing line;

means for accumulating said copies of said diverse publications fed to said co-mailing line into co-mailing stacks formed by copies of said diverse publications having a common indicia of said assembled mailing information; and means for preparing said co-mailing stacks of accumulated copies of diverse publications for mailing.

68. The co-mailing system of claim 67 wherein said preparing and addressing means includes a plurality of signature feeders, a gathering chain for receiving signatures from said feeders, a binding machine for binding said signatures into said publications, and an ink jet printer for addressing each of said diverse publications before said copies exit from said binding line.

69. The co-mailing system of claim 68 including computer means for controlling said signature feeders for preparing at least one of said diverse publications with selectively bound and/or internally customized copies.

70. The co-mailing system of claim 68 including computer means for controlling said ink jet printer for addressing each of said diverse publications with each of said copies substantially in zip code order.

71. The co-mailing system of claim 68 wherein said ink jet printer also applies a machine readable code to every copy of each of said diverse publications in the form of a bar code indicative of a zip code therefor.

72. The co-mailing system of claim 71 including a bar code reader downstream of said ink jet printer for sequentially machine reading said bar codes for every copy of each of said diverse publications.

73. The co-mailing system of claim 72 wherein said mailing information recording means includes computer means integral with said bar code reader for recording mailing information for each of said diverse publications.

74. The co-mailing system of claim 73 wherein said computer means is adapted to sequentially record an address including zip code for every copy of each of said diverse publications in the exact order of exit from said binding line.

75. The co-mailing system of claim 74 wherein said computer means is adapted to sequentially record an exact count of the number of copies for each zip code for each of said diverse publications.

76. The co-mailing system of claim 67 wherein said publication assembling means includes a separate spirally wound bundle or reel for sequentially assembling every copy of each of said diverse publications.

77. The co-mailing system of claim 76 wherein said publication placing means includes means for moving said separate spirally wound bundles or reels to a preselected location in proximity to said co-mailing line after assembling said diverse publications thereon.

78. The co-mailing system of claim 67 wherein said mailing information assembling means includes computer means for using the number of copies for each zip code from all of said diverse publications to maximize postal discount.

79. The co-mailing system of claim 67 wherein said information utilizing means includes computer means for controlling said copy accumulating means to feed copies of each of said diverse publications to said co-mailing line in zip code order.

80. The co-mailing system of claim 76 wherein said copy accumulating means includes a separate publication feeder for each of said diverse publications and an accumulating conveyor adapted to receive publications from said publication feeders.

81. The co-mailing system of claim 80 wherein said publication feeders each include a bundle or reel unwind stand, a copy separating device for forming a shingled stream of copies, and an accumulating hopper adjacent said accumulating conveyor.

82. The co-mailing system of claim 81 wherein said accumulating conveyor is an indexing conveyor positioned to travel below said accumulating hoppers of each of said publication feeders for receiving copies of said diverse publications contained therein.

83. The co-mailing system of claim 80 wherein said accumulating means includes computer means operatively associated with said publication feeders and accumulating conveyor for forming co-mailing stacks in zip code order.

84. The co-mailing system of claim 83 wherein said computer means is adapted to control said publication feeders and accumulating conveyor for forming said co-mailing stacks to have a maximum and a minimum number of copies of said diverse publications.

85. The co-mailing system of claim 80 wherein said publication feeders each include a pallet load inverter, a copy inverting gripper, a transport conveyor, and an accumulating hopper adjacent said accumulating conveyor.

86. The co-mailing system of claim 85 wherein said accumulating conveyor is an indexing conveyor positioned to travel below said accumulating hoppers of each of said publication feeders for receiving copies of said diverse publications contained therein.

87. The co-mailing system of claim 80 wherein said accumulating means includes computer means operatively associated with said publication feeders and accumulating conveyor for forming co-mailing stacks in zip code order.

88. The co-mailing system of claim 67 wherein said stack preparing means includes a shrink wrapping device for shrink wrapping each of said co-mailing stacks at the end of said co-mailing line.

89. The co-mailing system of claim 67 wherein said stack preparing means includes a strapping device for strapping each of said co-mailing stacks at the end of said co-mailing line.

90. The co-mailing system of claim 68 wherein said ink jet printer also applies a machine readable code to a zip code separator book, and means are provided for placing said zip code separator book on said binding line between copies of diverse publications destined for different zip codes.

91. The co-mailing system of claim 90 wherein said machine readable code comprises a bar code placed in a preselected location on each of said zip code separator books, said bar code being indicative of a particular zip code for every copy of each of said diverse publications upstream of each of said zip code separator books.

92. The co-mailing system of claim 91 wherein said mailing information recording means includes computer means for sequentially machine reading said bar codes on each of said zip code separator books, counting the number of copies upstream of each of said zip code separator books, and sequentially recording an exact count of the number of copies for each zip code for each of said diverse publications.

93. The co-mailing system of claim 92 including means for removing each of said zip code separator books from said copies of said diverse publications upstream of the point where said copies of said diverse publications are accumulated into said co-mailing stacks.

94. A system for co-mailing a plurality of diverse publications, comprising:

means for preparing and addressing multiple copies of each of said diverse publications on a binding line, said preparing and addressing means including a plurality of signature feeders, a gathering chain for receiving signatures from said feeders, a binding machine for binding said signatures into said publications, and an ink jet printer for addressing each of said diverse publications before said multiple copies exit from said binding line, and said preparing and addressing means being adapted to prepare at least one of said diverse publications with selectively bound and/or internally customized copies;

means for sequentially recording mailing information for each of said diverse publications prepared and addressed by said preparing and addressing means on said binding line to provide an exact count by zip code;

means for assembling each of said diverse publications in a predetermined order relative to the order each of said multiple copies exits from said binding line;

a co-mailing line for preparing a plurality of diverse publications for co-mailing therefrom;

means for placing each of said diverse publications in position for feeding each of said multiple copies to said co-mailing line in a predetermined order relative to the order of exit from said binding line;

means for assembling said mailing information for all of said diverse publications to control or otherwise facilitate operation of said co-mailing line by permitting said diverse publications to be accumulated for co-mailing purposes while determining the number of copies for each zip code for said diverse publications;

means for utilizing said assembled mailing information to feed copies of said diverse publications to said co-mailing line substantially in zip code order;

means for sequentially accumulating said copies of said diverse publications fed to said co-mailing line into co-mailing stacks in zip code order, said co-mailing stacks being formed by copies of said diverse publications having a common indicia of said assembled mailing information; and means for preparing said co-mailing stacks of accumulated copies of diverse publications for mailing.

95. The co-mailing system of claim 94 wherein said ink jet printer addresses every copy of each of said diverse publications substantially in zip code and carrier route order and applies a machine readable code to every copy of each of said diverse publications on said binding line indicative of a zip code and carrier route therefor.

96. The co-mailing system of claim 95 wherein said machine readable code comprises a bar code indicative of a zip code and carrier route for every copy of each of said diverse publications and said ink jet printer affixes an address and said bar code to every copy of each of said diverse publications on said binding line.

97. The co-mailing system of claim 96 including a bar code reader downstream of said ink jet printer for sequentially machine reading said bar codes for every copy of each of said diverse publications exiting said binding line, said mailing information recording means including computer means integral with said bar code reader for sequentially recording a zip code and carrier route for every copy of each of said diverse publications.

98. The co-mailing system of claim 97 wherein said computer means is adapted to sequentially record said zip codes and carrier routes in the exact order each copy of each of said diverse publications exits said binding line and is also adapted to sequentially record an exact count of the number of copies for each zip code and carrier route for each of said diverse publications.

99. The co-mailing system of claim 94 wherein said publication assembling means includes a separate spirally wound bundle or reel for assembling every copy of each of said diverse publications and said publication placing means includes means for moving each of said separate spirally wound bundle or reel to a preselected location for feeding said copies of said diverse publications to said co-mailing line.

100. The co-mailing system of claim 94 wherein said mailing information assembling means includes computer means for determining the number of copies for each zip code and carrier route for each of said diverse publications and for using the number of copies for each zip code and carrier route in order to maximize postal discount.

101. The co-mailing system of claim 100 wherein said assembled mailing information utilizing means includes computer means for controlling said copy accumulating means to feed copies of each of said diverse publications to said co-mailing line substantially in zip code and carrier route order for sequentially accumulating copies of each of said diverse publications into co-mailing stacks in zip code and carrier route order.

102. The co-mailing system of claim 101 wherein said copy accumulating means includes a separate publication feeder for each of said diverse publications and an accumulating conveyor adapted to receive publications from each of said publication feeders, said publication feeders each including a bundle or reel unwind stand, a copy separating device for forming a shingled stream of copies, and an accumulating hopper adjacent said accumulating conveyor.

103. The co-mailing system of claim 102 wherein said accumulating conveyor is an indexing conveyor positioned to travel below said accumulating hoppers of each of said publication feeders for receiving copies of said diverse publications contained therein.

104. The co-mailing system of claim 103 wherein said copy accumulating means includes computer means operatively associated with said publication feeders and accumulating conveyor for forming said co-mailing stacks in zip code and carrier route order, said computer means being adapted to control said publication feeders and accumulating conveyor for forming said co-mailing stacks to have a maximum and a minimum number of copies of said diverse publications.

105. The co-mailing system of claim 101 wherein said copy accumulating means includes a separate publication feeder for each of said diverse publications for sequentially assembling copies of each of said diverse publications from separate pallets, said publication feeders each including a pallet load inverter, a copy inverting gripper, a transport conveyor, and an accumulating hopper adjacent an accumulating conveyor.

106. The co-mailing system of claim 105 wherein said accumulating conveyor is an indexing conveyor positioned to travel below said accumulating hoppers of each of said publication feeders for receiving copies of said diverse publications contained therein.

107. The co-mailing system of claim 106 wherein said copy accumulating means includes computer means operatively associated with said publication feeders and accumulating conveyor for forming said co-mailing stacks in zip code and carrier route order, said computer means being adapted to control said publication feeders and accumulating conveyor for forming said co-mailing stacks to have a maximum and a minimum number of copies of said diverse publications.

108. The co-mailing system of claim 94 wherein said stack preparing means includes a shrink wrapping device for shrink wrapping each of said co-mailing stacks at the end of said co-mailing line.

109. The co-mailing system of claim 94 wherein said stack preparing means includes a strapping device for strapping each of said co-mailing stacks at the end of said co-mailing line.

110. The co-mailing system of claim 94 wherein said ink jet printer also applies a machine readable code to a zip code separator book, and means are provided for placing said zip code separator book on said binding line between copies of diverse publications destined for different zip codes.

111. The co-mailing system of claim 110 wherein said machine readable code comprises a bar code placed in a preselected location on each of said zip code separator books, said bar code being indicative of a particular zip code for every copy of each of said diverse publications upstream of each of said zip code separator books.

112. The co-mailing system of claim 111 wherein said mailing information recording means includes computer means for sequentially machine reading said bar codes on each of said zip code separator books, counting the number of copies upstream of each of said zip code separator books, and sequentially recording an exact count of the number of copies for each zip code for each of said diverse publications.

113. The co-mailing system of claim 112 including means for removing each of said zip code separator books from said copies of said diverse publications upstream of the point where said copies of said diverse publications are accumulated into said co-mailing stacks.

114. A system for co-mailing a plurality of diverse publications, comprising:

means for preparing and addressing multiple copies of each of said diverse publications on one or more binding lines, said preparing and addressing means including a plurality of signature feeders for each binding line, a gathering chain for receiving signatures from said feeders for each binding line, a binding machines for binding said signatures into said publications on each binding line, and an ink jet printer for each binding line for addressing each of said diverse publications before said multiple copies exit therefrom, and said preparing and addressing means being adapted to prepare at least one of said diverse publications from at least one binding line with selectively bound and/or internally customized copies;

means for sequentially recording mailing information for each of said diverse publications prepared and addressed by said preparing and addressing means on said binding lines in the exact order each of said multiple copies exits therefrom to provide an exact count by zip code and carrier route;

means for assembling each of said diverse publications in a reverse order relative to the order each of said multiple copies exits from said binding lines, said assembling means including a separate spirally wound bundle or reel for sequentially assembling every copy of each of said diverse publications thereon;

a common co-mailing line for all of said diverse publications, said co-mailing line including a separate publication feeder for each of said diverse publications and an accumulating conveyor adapted to receive publications from said publication feeders, said accumulating conveyor passing an exit point of each of said publication feeders;

means for placing each of said diverse publications in position for feeding each of said multiple copies to said co-mailing line in a reverse order relative to the order of exit from said binding lines, said placing means including means for separately moving each of said separate spirally wound bundles or reels to a preselected location relative to one of said publication feeders;

means for assembling said mailing information for all of said diverse publications to control operation of said co-mailing line by permitting said diverse publications to be accumulated for co-mailing purposes while determining the exact number of copies for each zip code and carrier route for said diverse publications;

means for utilizing said assembled mailing information for the purpose of feeding copies of said diverse publications to said co-mailing line, said assembled mailing information utilizing means being adapted to control or otherwise facilitate the operation of said co-mailing line whereby said diverse publications are fed in a predetermined sequence by said publication feeders to said accumulating conveyor, said assembled mailing information utilizing means feeding copies of said diverse publications to said co-mailing line substantially in zip code and carrier route order;

means for accumulating said copies of said diverse publications fed to said accumulating conveyor by said publication feeders into co-mailing stacks, said co-mailing stacks being formed by copies of said diverse publications having a common indicia of said assembled mailing information including zip code and carrier route therefor, said copy accumulating means being adapted to accumulate copies of said diverse publications into co-mailing stacks in zip code and carrier route order; and means for preparing said co-mailing stacks of accumulated copies of diverse publications for mailing.

115. The co-mailing system of claim 114 wherein said ink jet printer addresses every copy of each of said diverse publications substantially in zip code and carrier route order and applies a machine readable code to every copy of each of said diverse publications on said binding lines indicative of a zip code and carrier route therefor.

116. The co-mailing system of claim 115 wherein said machine readable code comprises a bar code indicative of a zip code and carrier route for every copy of each of said diverse publications and said ink jet printer affixes an address and said bar code to every copy of each of said diverse publications on said binding lines.

117. The co-mailing system of claim 116 including a bar code reader downstream of said ink jet printer for sequentially machine reading said bar codes for every copy of each of said diverse publications exiting said binding lines, said mailing information recording means including computer means integral with said bar code reader for sequentially recording a zip code and carrier route for every copy of each of said diverse publications.

118. The co-mailing system of claim 114 wherein said mailing information assembling means includes computer means for determining the number of copies for each zip code and carrier route for each of said diverse publications and for using the number of copies for each zip code and carrier route in order to maximize postal discount.

119. The co-mailing system of claim 116 wherein said publication feeders each include a bundle or reel unwind stand, a copy separating device for forming a shingled stream of copies, a bar code reader, and an accumulating hopper adjacent said accumulating conveyor.

120. The co-mailing system of claim 119 wherein said accumulating conveyor is an indexing conveyor positioned to travel below said accumulating hoppers of each of said publication feeders for receiving copies of said diverse publications contained therein.

121. The co-mailing system of claim 120 wherein said mailing information and utilizing means employ a central processing unit operatively associated with said accumulating conveyors and each of said publication feeders.

122. The co-mailing system of claim 114 wherein said ink jet printer also applies a machine readable code to a zip code and carrier route separator book, and means are provided for placing said zip code and carrier route separator book on said binding lines between copies of diverse publications destined for different zip codes.

123. The co-mailing system of claim 122 wherein said machine readable code comprises a bar code placed in a preselected location on each of said zip code and carrier route separator books, said bar code being indicative of a particular zip code and carrier route for every copy of each of said diverse publications upstream of each of said zip code and carrier route separator books.

124. The co-mailing system of claim 123 wherein said mailing information recording means includes computer means for sequentially machine reading said bar codes on each of said zip code and carrier route separator books, counting the number of copies upstream of each of said zip code and carrier route separator books, and sequentially recording an exact count of the number of copies for each zip code and carrier route for each of said diverse publications.

125. The co-mailing system of claim 124 including means for removing each of said zip code and carrier route separator books from said copies of said diverse publications upstream of the point where said copies of said diverse publications are accumulated into said co-mailing stacks.

126. A system for co-mailing a plurality of diverse publications, comprising:

means for preparing and addressing multiple copies of each of said diverse publications on one or more binding lines, said preparing and addressing means including a plurality of signature feeders for each binding line, a gathering chain for receiving signatures from said feeders for each binding line, a binding machine for binding said signatures into said publications on each binding line, and an ink jet printer for each binding line for addressing each of said diverse publications before said multiple copies exit therefrom, and said preparing and addressing means being adapted to prepare at least one of said diverse publications from at least one binding line with selectively bound and/or internally customized copies;

means for sequentially recording mailing information for each of said diverse publications prepared and addressed by said preparing and addressing means on said binding lines in the exact order each of said multiple copies exits therefrom to provide an exact count by zip code and carrier route;

means for assembling each of said diverse publications in a reverse order relative to the order each of said multiple copies exits from said binding lines, said assembling means including a separate pallet for sequentially assembling every copy of each of said diverse publications thereon;

a common co-mailing line for all of said diverse publications, said co-mailing line including a separate publication feeder for each of said diverse publications and an accumulating conveyor adapted to receive publications from said publication feeders, said accumulating conveyor passing an exit point of each of said publication feeders;

means for placing each of said diverse publications in position for feeding each of said multiple copies to said co-mailing line in the exact order of exit from said binding lines, said placing means including means for separately inverting and moving each of said separate pallets to a preselected location relative to one of said publication feeders;

means for assembling said mailing information for all of said diverse publications to control operation of said co-mailing line by permitting said diverse publications to be accumulated for co-mailing purposes while determining the exact number of copies for each zip code and carrier route for said diverse publications;

means for utilizing said assembled mailing information for the purpose of feeding copies of said diverse publications to said co-mailing line, said assembled mailing information utilizing means being adapted to control or otherwise facilitate the operation of said co-mailing line whereby said diverse publications are fed in a predetermined sequence by said publication feeders to said accumulating conveyor, said assembled mailing information utilizing means feeding copies of said diverse publications to said co-mailing line substantially in zip code and carrier route order;

means for accumulating said copies of said diverse publications fed to said accumulating conveyor by said publication feeders into co-mailing stacks, said co-mailing stacks being formed by copies of said diverse publications having a common indicia of said assembled mailing information including zip code and carrier route therefor, said copy accumulating means being adapted to accumulate copies of said diverse publications into co-mailing stacks in zip code and carrier route order; and means for preparing said co-mailing stacks of accumulated copies of diverse publications for mailing.

127. The co-mailing system of claim 126 wherein said ink jet printer addresses every copy of each of said diverse publications substantially in zip code and carrier route order and applies a machine readable code to every copy of each of said diverse publications on said binding lines indicative of a zip code and carrier route therefor.

128. The co-mailing system of claim 127 wherein said machine readable code comprises a bar code indicative of a zip code and carrier route for every copy of each of said diverse publications and said ink jet printer affixes an address and said bar code to every copy of each of said diverse publications on said binding lines.

129. The co-mailing system of claim 128 including a bar code reader downstream of said ink jet printer for sequentially machine reading said bar codes for every copy of each of said diverse publications exiting said binding lines, said mailing information recording means including computer means integral with said bar code reader for sequentially recording a zip code and carrier route for every copy of each of said diverse publications.

130. The co-mailing system of claim 126 wherein said mailing information assembling means includes computer means for determining the number of copies for each zip code and carrier route for each of said diverse publications and for using the number of copies for each zip code and carrier route in order to maximize postal discount.

131. The co-mailing system of claim 126 wherein said publication feeders each include a pallet load inverter, a copy inverting gripper, a transport conveyor, a bar code reader, and an accumulating hopper adjacent said accumulating conveyor.

132. The co-mailing system of claim 131 wherein said accumulating conveyor is positioned to travel below said accumulating hoppers of each of said publication feeders for receiving copies of said diverse publications contained therein.

133. The co-mailing system of claim 120 wherein said mailing information and utilizing means employ a central processing unit operatively associated with said accumulating conveyors and each of said publication feeders.

134. The co-mailing system of claim 126 wherein said ink jet printer also applies a machine readable code to a zip code and carrier route separator book, and means are provided for placing said zip code and carrier route separator book on said binding lines between copies of diverse publications destined for different zip codes.

135. The co-mailing system of claim 134 wherein said machine readable code comprises a bar code placed in a preselected location on each of said zip code and carrier route separator books, said bar code being indicative of a particular zip code and carrier route for every copy of each of said diverse publications upstream of each of said zip code and carrier route separator books.

136. The co-mailing system of claim 135 wherein said mailing information recording means includes computer means for sequentially machine reading said bar codes on each of said zip code and carrier route separator books, counting the number of copies upstream of each of said zip code and carrier route separator books, and sequentially recording an exact count of the number of copies for each zip code and carrier route for each of said diverse publications.

137. The co-mailing system of claim 136 including means for removing each of said zip code and carrier route separator books from said copies of said diverse publications upstream of the point where said copies of said diverse publications are accumulated into said co-mailing stacks.

* * * * *